US007891181B2

(12) United States Patent
Baltes

(10) Patent No.: US 7,891,181 B2
(45) Date of Patent: Feb. 22, 2011

(54) HYDRAULIC UNIT

(75) Inventor: Herbert Baltes, Losheim (DE)

(73) Assignee: Hydac Technology GmbH, Sulzbach/Saar (DE)

( * ) Notice: Subject to any disclaimer, the term of this patent is extended or adjusted under 35 U.S.C. 154(b) by 369 days.

(21) Appl. No.: 11/992,053

(22) PCT Filed: Aug. 5, 2006

(86) PCT No.: PCT/EP2006/007768

§ 371 (c)(1),
(2), (4) Date: Mar. 14, 2008

(87) PCT Pub. No.: WO2007/051502

PCT Pub. Date: May 10, 2007

(65) Prior Publication Data

US 2009/0120084 A1 May 14, 2009

(30) Foreign Application Priority Data

Nov. 2, 2005 (DE) ..... 10 2005 052 108

(51) Int. Cl.
*B66F 9/22* (2006.01)
*F15B 1/02* (2006.01)

(52) U.S. Cl. ..... 60/414; 60/416

(58) Field of Classification Search ..... 60/414, 60/416

See application file for complete search history.

(56) References Cited

U.S. PATENT DOCUMENTS 4,761,954 A * 8/1988 Rosman ..... 60/414
6,460,332 B1 10/2002 Maruta et al.

FOREIGN PATENT DOCUMENTS

| | | | |
|---|---|---|---|
| DE | 198 44 648 | A1 | 2/2000 |
| DE | 10 2004 044 244 | A1 | 3/2006 |
| EP | 0 777 055 | A2 | 6/1997 |
| JP | 07-125994 | A | 5/1995 |

* cited by examiner

*Primary Examiner*—Thomas E Lazo
(74) *Attorney, Agent, or Firm*—Roylance, Abrams, Berdo & Goodman, LLP

(57) ABSTRACT

A hydraulic unit, in particular for lifting and lowering loads in stacking trucks, has at least one working cylinder (10). The piston/rod unit (12) of the cylinder is guided movably in a housing (22). By a hydraulic pump (25), the piston/rod unit can be extended in its one drive direction (30) and can be retracted in its other opposite drive direction (32). A control device (20) actuates the displacement movements to that effect. A storage device (38) is fed energy in one drive direction (32). The energy fed in can be called up from the storage device (38) to assist a displacement movement in an opposite drive direction (30).

9 Claims, 1 Drawing Sheet

HYDRAULIC UNIT

FIELD OF THE INVENTION

The present invention relates to a hydraulic unit, especially for raising and lowering loads in stacking trucks. At least one working cylinder has a piston-rod unit movably guided in a housing, extendable by a hydraulic pump in its one drive direction and retractable in its other, opposite drive direction. A control actuates these displacement movements.

BACKGROUND OF THE INVENTION

DE 10 2004 044 244, published at a later date, discloses as the hydraulic unit a spring system, in particular for use in the lifting frame of a forklift. The unit has at least one hydraulic accumulator and at least one switching valve for producing a fluid-carrying connection by a control line between the hydraulic accumulator and a working cylinder which can actuate the lifting frame. Lifting and lowering lines actuate the working cylinder into a raised or lowered position, with the lifting line and the lowering line each discharging into a main branch and being parallel to one another. One connecting point upstream and downstream from the switching valve discharges into the control line. Valves are connected to the main branches, which valves have an opposite action direction or actuation direction for each main branch. With this design a type of hydraulic Graetz circuit is implemented. With this arrangement, it is possible with only a few installation components and especially only using one hydraulic accumulator to achieve active load damping or cushioning in the lifting frame of the forklift. More energy-efficient operation is, however, not possible with this known solution.

The prior art furthermore discloses generic hydraulic units in which two working cylinders connected to one another on the piston side in the form of so-called plunger cylinders are connected to a conventional hydraulic pump. The hydraulic pump made as a constant delivery pump can have two opposite directions of rotation and accordingly two opposite transport directions for the fluid medium used. A control means, which can be actuated on the operator side as a control block, allows actuation of the hydraulic pump. A conventional electric motor is used for driving the pump. To extend the working cylinders to lift a load in the known solution, the hydraulic pump takes fluid from a tank storage vessel and pushes the removed fluid to the piston side of the respective working cylinder unit. To lower the load and thus to retract the working cylinders, the direction of rotation of the hydraulic pump is reversed. The fluid displaced via the piston side travels in turn to the tank side of the hydraulic unit. To raise and lower loads, the known unit requires high hydraulic pump work capacity and therefore a high driving power for the upstream electric motor. The known hydraulic unit is also limited with respect to the possible displacement speed for the working cylinders.

SUMMARY OF THE INVENTION

An object of the present invention is to provide an improved, energy-efficient hydraulic unit at low cost.

This object is basically achieved by a hydraulic unit including a storage device which feeds energy in one direction of driving of the hydraulic pump. The supplied energy can be retrieved from the storage device to support displacement movement for the opposite driving direction of the hydraulic pump. In particular, the movement of load lifting can be carried out with energy support from the storage device. This arrangement results in lower driving power for the hydraulic pump with its motor. The retrieved energy at a high pressure level of the fluid from the storage device can also be used for faster displacement movements on the respective working cylinder. This use benefits a high-speed operating process. By using the storage device, overall harmonical operation of the entire hydraulic unit without jolts can be achieved. By simply reversing the direction of rotation of the hydraulic pump, the amount of fluid displaced from the working cylinder when the load is lowered can be pushed into the storage device to increase the pressure level and can be retrieved again from there in the next working cycle.

It has been found to be especially advantageous to use a hydraulic accumulator, particularly as a piston accumulator, for the storage device. As part of the control guided on the operator side, a valve unit is used to establish or interrupt a fluid-carrying connection between the hydraulic pump and the storage device.

In spite of the expected additional costs for an additional storage device, preferably in the form of a hydraulic accumulator, the expected savings due to energy-efficient operation can be assumed to be higher. Even for a short interval of use of energy storage, these additional costs are equalized. Operating costs overall can therefore be reduced in these hydraulic units by using the storage device.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
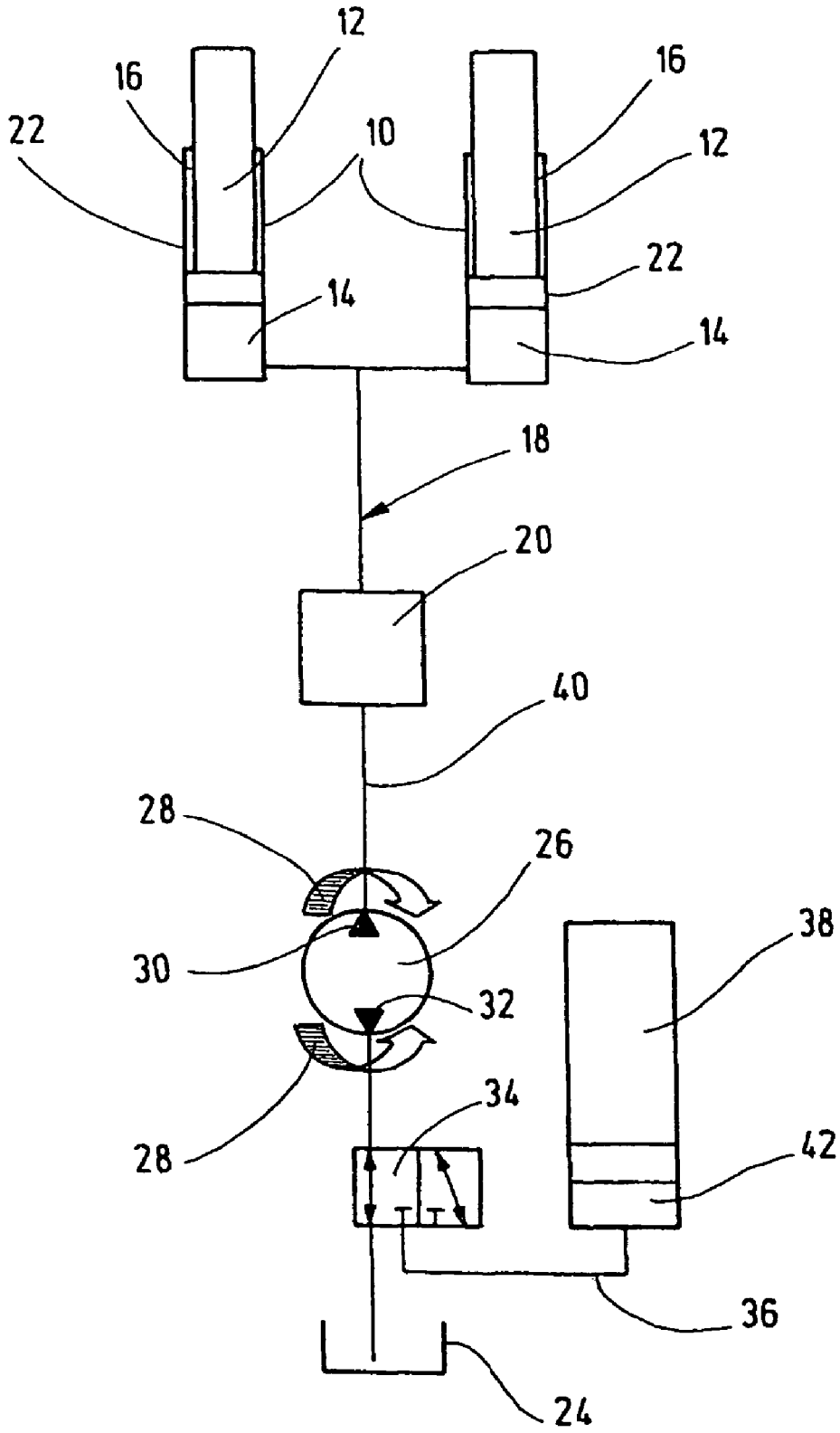
FIG. 1 is a block diagram, not to scale, schematically illustrating a hydraulic unit according to an exemplary embodiment of the present invention.

The hydraulic unit is used, in particular, to raise and lower loads (not detailed) in stacking trucks such as forklifts or other industrial trucks. The unit has two working cylinders 10 of conventional design, also referred to as plunger cylinders. Each working cylinder 10 has a piston-rod unit 12 dividing the respective working cylinder 10 essentially fluid-tight into a piston side 14 and a rod side 16. The two piston sides 14 of the working cylinders 10 are connected to one another to carry fluid (i.e., in fluid communication) via a connecting line 18. In this way, they are connected to the operator-guided control 20 in the manner of a control block. The rod sides 16 are supplied with fluid as necessary, conventionally in a manner not detailed. This amount of fluid can also be suitably transported out of the rod side 16 as an annulus.

The respective piston-rod unit 12 is guided in the housing 22 of the working cylinder 10. For a process of lifting a load (not detailed) and/or for extending the lifting frame of a forklift, as viewed in FIG. 1, the piston rod unit 12 is extended upward from the housing 22. For a lowering process, the piston-rod unit 12 moves in the direction to the piston side 14 of each working cylinder 10. These lifting and lowering processes are known so that they will be described further in detail.

Between the control 20 and a supply or storage tank 24, a conventional hydraulic pump 26 with two opposite directions of rotation, indicated in FIG. 1 with arrows 28, is connected to the connecting line 18. With respect to the opposite directions of rotation 28, the hydraulic pump 26 can transport fluid in two opposite flow directions 30, 32 as shown in FIG. 1 by the standard arrows of the standardized drawing of the hydraulic pump 26. The hydraulic pump 26 can be made as a constant delivery pump.

Between the hydraulic pump 26 and the tank 24, a valve unit 34 is connected as a 3/2-way or switching valve as shown in the FIGURE in one actuating position for which a fluid-carrying connection is between the hydraulic pump 26 and the tank 24. A branch line 36 to the storage device 38 in the form of a hydraulic accumulator, particularly a piston accumulator, is blocked in this illustrated first switching position. In the other inhibition or second switching position of the directional valve, conversely a fluid-carrying connection is established between the branch line 36 and entry side of the hydraulic pump 26, and the tank connection to the tank 24 is blocked.

The operator-guided control 20 is able to analogously actuate both the hydraulic pump 26 and the valve unit 34. A conventional electric motor (not detailed) can be actuated by the control 20 to operate the hydraulic pump 26. For monitoring of system states, a measurement point 40 is connected between the control 20 and the hydraulic pump 26 to monitor the pressure of the system, for example. Depending on the sensors used, more extensive monitoring activities can also be carried out, even in combination with one another, relative to the temperature, viscosity, degree of fouling, etc., of the respective fluid used.

When the hydraulic unit is initially started up and when the accumulator 38 is not filled on the fluid side, the valve unit 34 is in the switching position in FIG. 1. The hydraulic pump 26 takes fluid from the tank 24 and pushes the amount referred to in the direction of the piston side 14 of the working cylinders 10 for a lifting process. If at this point the load is lowered, the valve 34 is actuated and the amount of fluid returned via the hydraulic pump 26 at this point travels to the fluid side 42 of the storage device 38. The fluid lifts the piston against the working gas storage in storage device 38. For a hydraulic accumulator, the separating element such as a piston or a membrane separates the fluid side from the gas side enclosed in the accumulator housing. In this way, the accumulator can store energy compressed. If at this point a repeated load lifting process is actuated, the energy stored in the storage device 38 in the form of a high pressure level is retrieved and supports the lifting movement by the amount of fluid retrieved from the accumulator being pushed toward the piston side 14 of the respective working cylinder 10. In this way, a type of energy storage can be achieved which can support the load lifting process when called upon.

The hydraulic unit according to the present invention is characterized by use of the storage device 38 in that short system and reaction times are possible at high extension and retraction speeds for the working cylinders 10 used. The electric drive of the hydraulic pump 26 is relieved accordingly. All working movements damped by energy input into the storage device 38 take place harmonically, and thus, without jolting. In spite of the additional costs for implementation of the storage device 38, especially in long-term operation, the accompanying energy savings is more cost-efficient than in systems without a storage device. The transport or capacity performance of the hydraulic pump 26 can also be cut back by using the energy storage device 38, helping reduce production costs.

The hydraulic pump used, as shown, can have two directions of rotation. The two directions of rotation, however, can also be implemented by the electric motor. The constant delivery pump can be replaced by a variable delivery pump. The electric motor can also be replaced by another drive device, for example, by an internal combustion engine, preferably in the form of a diesel engine, a machine or the like. The hydraulic unit according to the present invention is not limited to use in stacking trucks, but can preferably be used wherever potential energy can be applied with the respective working cylinder. Analogous use is accordingly possible in machines such as excavators, elevators and handling devices (manipulators).

The directional valve used in the circuit shown in FIG. 1 is made as a 3/2-way valve. Implementation with a 3/3-way valve contributing according to the switching position to relieving the control means 38 is also conceivable. The control 20 shown in FIG. 1 need not be implemented in this way, and accordingly, can be omitted. Basically only one control is necessary for actuating the motor and/or the hydraulic pump. Instead of the control 20 shown in FIG. 1, a pipe shearing pin or the like can be inserted into the hydraulic unit (not shown). Corresponding sensors with measurement points for the hydraulic accumulator can also be inserted into the actuation of the overall system. Thus, other conclusions for actuating the overall hydraulic unit can also drawn, for example, by monitoring the piston position of the hydraulic accumulator and via the degree of its fill volume and/or fill pressure.

While one embodiment has been chosen to illustrate the present invention, it will be understood by those skilled in the art that various changes and modifications can be made therein without departing from the scope of the present invention as defined in the appended claims.

What is claimed is:

1. A hydraulic unit, comprising:

at least one working cylinder having a housing and a piston-rod unit movably guided in said housing;

a hydraulic pump in fluid communication with said working cylinder for lowering said piston-rod unit in a first drive direction thereof and for raising said piston-rod unit in an opposite second drive direction thereof;

a control coupled to said pump for actuating movement of said piston-rod unit;

a hydraulic accumulator in fluid communication with said working cylinder receiving energy in said first drive direction and supplying energy to support displacement movement for said second driving direction; and a valve unit connecting and disconnecting said hydraulic accumulator in fluid communication with said working cylinder and actuated by said control, said valve unit being a directional control valve having a first switching position providing fluid communication between said hydraulic pump and a tank connection and having a second switching position providing fluid communication between said hydraulic pump and said hydraulic accumulator.

2. A hydraulic unit according to claim 1 wherein said working cylinder raises and lowers loads in a stacking truck.

3. A hydraulic unit according to claim 1 wherein said hydraulic accumulator is a piston accumulator.

4. A hydraulic unit according to claim 1 wherein said control is connected in fluid communication between said working cylinder and an output side of said hydraulic pump.

5. A hydraulic unit according to claim 4 wherein a measuring point is coupled to a line providing fluid communication between said control and said output side of said hydraulic pump.

6. A hydraulic unit according to claim 5 wherein said measuring point is a pressure measurement point.

7. A hydraulic unit according to claim 1 wherein another working cylinder is provided to form a double cylinder arrangement connected in fluid communication to an output side of said control to provide fluid to piston sides of said working cylinders.

8. A hydraulic unit according to claim 1 wherein said valve unit is located in fluid communication between said tank connection, said hydraulic accumulator and said hydraulic pump.

9. A hydraulic unit according to claim 1 wherein said valve unit is located in direct fluid communication between said tank connection, said hydraulic accumulator and said hydraulic pump.

* * * * *